US011115767B2

(12) United States Patent
Chu et al.

(10) Patent No.: US 11,115,767 B2
(45) Date of Patent: Sep. 7, 2021

(54) DIAPHRAGM STRUCTURE AND METHOD OF MANUFACTURING THE SAME

(71) Applicant: National Taiwan University of Science and Technology, Taipei (TW)

(72) Inventors: Jinn P. Chu, Taipei (TW); Chia-Chi Yu, Taipei (TW); Bo-Zhang Lai, Taipei (TW); Chun-Tao Chen, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 489 days.

(21) Appl. No.: 16/186,429

(22) Filed: Nov. 9, 2018

(65) Prior Publication Data

US 2020/0068328 A1 Feb. 27, 2020

(30) Foreign Application Priority Data

Aug. 24, 2018 (TW) ..... 107129528

(51) Int. Cl.
*H04R 31/00* (2006.01)
*H04R 7/12* (2006.01)

(52) U.S. Cl.
CPC ..... *H04R 31/003* (2013.01); *H04R 7/127* (2013.01); *H04R 2307/023* (2013.01); *H04R 2307/025* (2013.01); *H04R 2307/027* (2013.01)

(58) Field of Classification Search
CPC ..... H04R 31/003; H04R 7/127; H04R 2307/023; H04R 2307/025; H04R 2307/027; H04R 2307/029; C22C 38/50; C22C 38/42; C22C 38/54; C22C 38/40; C22C 45/10; C22C 45/00; C22C 45/02
See application file for complete search history.

(56) References Cited

U.S. PATENT DOCUMENTS 5,744,761 A * 4/1998 Ogura ..... H04R 7/125 181/167
2017/0289689 A1* 10/2017 Guo ..... H04R 7/24
2018/0324526 A1* 11/2018 Itano ..... H04R 7/12
2018/0343532 A1* 11/2018 Lee ..... H04R 9/025

* cited by examiner

*Primary Examiner* — Sunita Joshi
(74) *Attorney, Agent, or Firm* — JCIPRNET

(57) ABSTRACT

A diaphragm structure is used for an audio signal output device. The diaphragm structure includes a film substrate, a polymer fiber structure and a thin film metallic glass. The film substrate includes a first surface and a second surface opposite to the first surface. The polymer fiber structure is combined with the first surface of the film substrate. The thin film metallic glass is formed on at least a part of the second surface of the film substrate.

13 Claims, 5 Drawing Sheets

DIAPHRAGM STRUCTURE AND METHOD OF MANUFACTURING THE SAME

CROSS-REFERENCE TO RELATED APPLICATION

This application claims the priority benefits of Taiwan Patent Application No. 107129528, filed on Aug. 24, 2018, the entirety of which is hereby incorporated by reference herein and made a part of this specification.

BACKGROUND OF THE INVENTION

1. Field of the Invention

The present disclosure generally relates to a diaphragm structure, and more particularly to a diaphragm structure combined with a metallic glass material. The present disclosure further comprises a method of manufacturing the diaphragm structure.

2. Description of Related Art

Generally, an audio output device such as a speaker or a headphone has a diaphragm structure inside. When sound signals are output, vibrations of the diaphragm structure are generated to transmit the sound. In order to generate effective vibration by the diaphragm structure with sound signals of different frequencies, the diaphragm structure is preferably made of a material having high rigidity, low density and appropriate damping characteristics. Therefore, the selection of the materials of the diaphragm structure is often an important factor for determining the performance of the diaphragm structure.

At present, most diaphragm structures are made of polymer materials. An obvious disadvantage of this kind of diaphragm structure is that polymer materials are softer and thus have insufficient rigidity, such that sound distortion may occur when high-frequency sound signals are transmitted by the diaphragm structure. If a metal material is plated on the polymer material, the rigidity of the entire diaphragm structure can be improved. However, as the thickness of the diaphragm structure increases, the frequency response of the diaphragm structure is affected, and the internal loss is additionally reduced by the metal plating layer such that the pitch is deteriorated. Therefore, there is a need to provide a diaphragm structure with high rigidity, low density and appropriate damping characteristics.

SUMMARY OF THE INVENTION

A primary object of this disclosure is to provide a diaphragm structure combined with a metallic glass material.

To achieve the aforesaid and other objects, the diaphragm structure of this disclosure comprises a film substrate, a polymer fiber structure and a thin film metallic glass. The film substrate comprises a first surface and a second surface opposite to the first surface. The polymer fiber structure is combined with the first surface of the film substrate. The thin film metallic glass is formed on at least a part of the second surface of the film substrate.

In one embodiment of this disclosure, a metallic glass target is deposited on the second surface of the film substrate by magnetron sputtering to form the thin film metallic glass.

In one embodiment of this disclosure, the film substrate further comprises a dome and an outer edge around the dome, the dome is protruded from the second surface, and the thin film metallic glass is formed on the dome.

In one embodiment of this disclosure, the thin film metallic glass is formed on the dome and the outer edge.

In one embodiment of this disclosure, the thin film metallic glass comprises an iron-based metallic glass material, a zirconium-based metallic glass material or a copper-based metallic glass material.

In one embodiment of this disclosure, the iron-based metallic glass material comprises a $Fe_aTi_bCo_cNi_dB_eNb_f$ alloy, wherein a is 65±10 at %, b is 13±5 at %, c is 8±5 at %, d is 7±5 at %, e is 6±5 at % and f is 1±5 at %, and wherein a, b, c, d, e and f represent integers greater than or equal to 1 and a+b+c+d+e+f=100.

In one embodiment of this disclosure, the zirconium-based metallic glass material comprises a $Zr_aCu_bAl_cTa_d$ alloy, wherein a is 55±10 at %, b is 30±5 at %, c is 10±5 at % and d is 10±5 at %, and wherein a, b, c and d represent integers greater than or equal to 1 and a+b+c+d=100.

In one embodiment of this disclosure, the copper-based metallic glass material comprises a $Cu_aZr_bAl_cTi_d$ alloy, wherein a is 55±10 at %, b is 30±5 at %, c is 10±5 at % and d is 10±5 at %, and wherein a, b, c and d represent integers greater than or equal to 1 and a+b+c+d=100.

In one embodiment of this disclosure, the thin film metallic glass has a thickness of 250 nm to 10 mm.

In one embodiment of this disclosure, the diaphragm structure has a rigidity of 34 N/m to 36 N/m.

In one embodiment of this disclosure, an absorbable energy of the diaphragm structure under stress ranges from $23*10^{-12}$ joule to $44*10^{-12}$ joule.

In one embodiment of this disclosure, when an audio signal having a frequency of between 8 kHz and 10 kHz is outputted, an oscillation amplitude of a sound pressure level produced by the diaphragm structure is maintained at below 5 dB.

In one embodiment of this disclosure, when an audio signal having a frequency of between 40 Hz and 1.5 kHz is outputted, a sound pressure level produced by the diaphragm structure is maintained within a range defined by a stable value±1 dB.

Another object of this disclosure is to provide the method of manufacturing the diaphragm structure. The method comprises: providing a film substrate comprising a first surface and a second surface opposite to the first surface; combining a polymer fiber structure with the first surface of the film substrate; and sputtering a metallic glass target on at least a part of the second surface of the film substrate to form a thin film metallic glass.

BRIEF DESCRIPTION OF THE DRAWINGS

The accompanying drawings are included to provide further understanding of the invention and are incorporated in and constitute a part of this specification. The drawings illustrate embodiments of the invention and, together with the descriptions, serve to explain the principles of the invention.

DESCRIPTION OF THE EMBODIMENTS

Since the various aspects and embodiments described herein are merely exemplary and not limiting, after reading this specification, skilled artisans will appreciate that other aspects and embodiments are possible without departing from the scope of the disclosure. Other features and benefits of any one or more of the embodiments will be apparent from the following detailed description and the claims.

The use of "a" or "an" is employed to describe elements and components described herein. This is done merely for convenience and to give a general sense of the scope of the invention. Accordingly, this description should be read to include one or at least one and the singular also includes the plural unless it is obvious that it is meant otherwise.

As used herein, the terms "first," "second," and the like are used for distinguishing between or referring to identical or similar elements or structures and not necessarily for describing a sequential or chronological order thereof. It should be understood that the terms so used are interchangeable under appropriate circumstances or configurations.

As used herein, the terms "comprises," "comprising," "includes," "including," "has," "having" or any other variation thereof are intended to cover a non-exclusive inclusion. For example, a component, structure, article, or apparatus that comprises a list of elements is not necessarily limited to only those elements but may include other elements not expressly listed or inherent to such component, structure, article, or apparatus.

Figure 1:
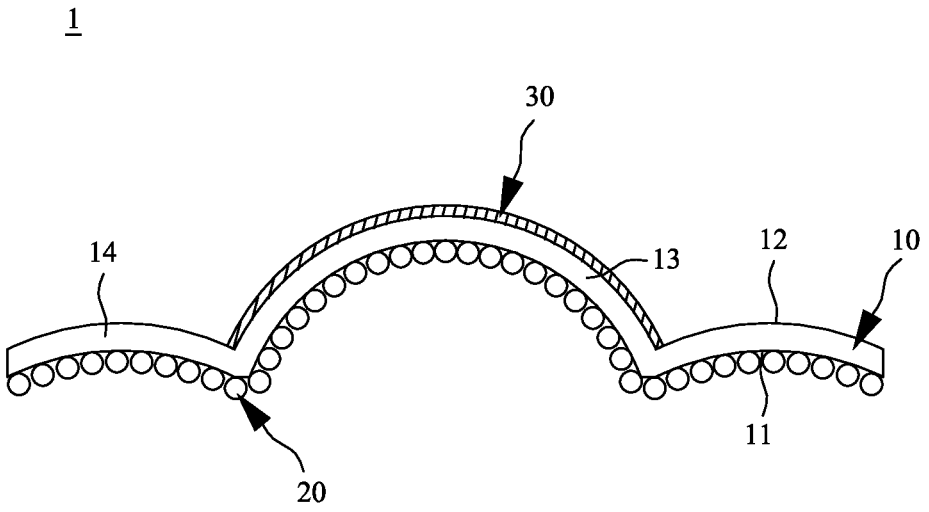
FIG. 1 illustrates a cross-sectional view of a diaphragm structure of this disclosure.
Figure 2:
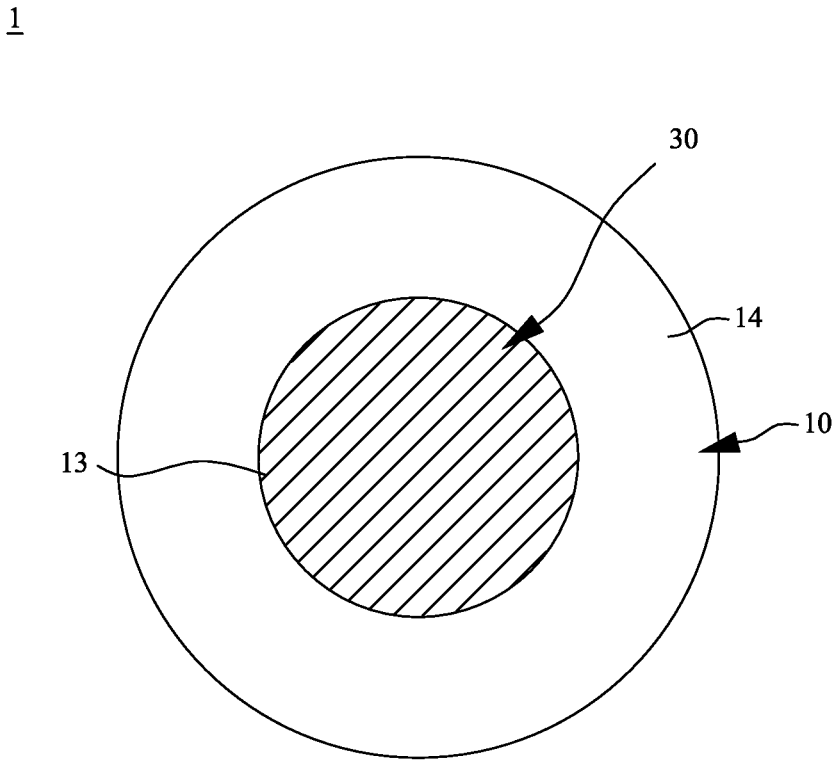
FIG. 2 illustrates a top view of the diaphragm structure of this disclosure.

Please refer to FIG. 1 and FIG. 2. FIG. 1 illustrates a cross-sectional view of a diaphragm structure of this disclosure, and FIG. 2 illustrates a top view of the diaphragm structure of this disclosure. As illustrated in FIG. 1 and FIG. 2, the diaphragm structure 1 of this disclosure is substantially a laminar structure. The diaphragm structure 1 of this disclosure comprises a film substrate 10, a polymer fiber structure 20 and a thin film metallic glass 30. The film substrate 10 is mainly used as a structural support member of the diaphragm structure 1 of this disclosure, and the film substrate 10 comprises a polymer material. In one embodiment of this disclosure, the film substrate 10 may comprise polyurethane (PU), but this disclosure is not limited thereto. The film substrate 10 may also comprise plastic materials, such as nylon fibers, polyvinyl chloride (PVC), polyethylene terephthalate (PET), polycarbonate (PC) or polyethylene (PE).

In one embodiment of this disclosure, the film substrate 10 is similar to a disk-shaped structure, and the film substrate 10 comprises a first surface 11, a second surface 12, a dome 13 and an outer edge 14. The first surface 11 and the second surface 12 are two opposite surfaces. The dome 13 is a partial spherical structure protruded from the second surface 12. The outer edge 14 is a planar structure extended outward from the edge of the dome 13, and the outer edge 14 surrounds the dome 13. The three-dimensional structure of the film substrate 10 can be formed by die-casting, and a surface pattern can be formed on the surface of the outer edge 14 on the second surface 12 as needed.

The polymer fiber structure 20 is combined with the first surface 11 of the film substrate 10. The polymer fiber structure 20 is mainly used as a structural reinforcement of the diaphragm structure 1 of this disclosure for enhancing the intensity of the film substrate 10. Here, the polymer fiber structure 20 comprises a structural member made of woven fibers which comprise polymer materials, and the polymer fiber structure 20 has a certain toughness and strength in structural design. In one embodiment of this disclosure, the polymer fiber structure 20 may comprise nylon fibers, but this disclosure is not limited thereto. The polymer fiber structure 20 may also comprise plastic materials, such as PVC, PET, PC, PE or PU. The polymer fiber structure 20 can be combined with the film substrate 10 by die-casting or bonding.

The thin film metallic glass 30 is formed on at least a part of the second surface 12 of the film substrate 10. The thin film metallic glass 30 is mainly used as a structural reinforcement of the diaphragm structure 1 of this disclosure for enhancing the intensity of the film substrate 10 and improving the characteristics of the film substrate 10. Here, a metallic glass target is deposited on the second surface 12 of the film substrate 10 by magnetron sputtering to form the thin film metallic glass 30. In one embodiment of this disclosure, the thin film metallic glass 30 is formed on the surface of the dome 13 on the second surface 12, but this disclosure is not limited thereto. For example, the thin film metallic glass 30 is capable of covering entirely the second surface 12; in other words, the thin film metallic glass 30 is formed on the surface of the dome 13 and the outer edge 14 on the second surface 12. The thin film metallic glass 30 has a thickness of 250 nm to 10 mm.

The main component of the thin film metallic glass 30 comprises at least one element selected from the group consisting of: iron, zirconium, copper, nickel, titanium, cobalt, ruthenium, boron and tungsten. In one embodiment of this disclosure, the thin film metallic glass 30 may comprise an iron-based metallic glass material, a zirconium-based metallic glass material or a copper-based metallic glass material, but this disclosure is not limited thereto. The thin film metallic glass 30 may also comprise other metallic glass materials having similar characteristics.

Taking an iron-based metallic glass material as an example, in one embodiment of this disclosure, the iron-based metallic glass material comprises a $Fe_aTi_bCo_cNi_dB_eNb_f$ alloy, wherein a is 65±10 at %, b is 13±5 at %, c is 8±5 at %, d is 7±5 at %, e is 6±5 at % and f is 1±5 at %, and wherein a, b, c, d, e and f represent integers greater than or equal to 1 and a+b+c+d+e+f=100.

Taking an zirconium-based metallic glass material as an example, in one embodiment of this disclosure, the zirconium-based metallic glass material comprises a $Zr_aCu_bAl_cTa_d$ alloy, wherein a is 55±10 at %, b is 30±5 at %, c is 10±5 at % and d is 10±5 at %, and wherein a, b, c and d represent integers greater than or equal to 1 and a+b+c+d=100.

Taking an copper-based metallic glass material as an example, in one embodiment of this disclosure, the copper-based metallic glass material comprises a $Cu_aZr_bAl_cTi_d$ alloy, wherein a is 55±10 at %, b is 30±5 at %, c is 10±5 at % and d is 10±5 at %, and wherein a, b, c and d represent integers greater than or equal to 1 and a+b+c+d=100.

Since the metallic glass material has a suitable elastic modulus and a better elastic recovery coefficient, metallic sounds do not appear when the sound signals are transmitted via the diaphragm structure 1 formed on the thin film metallic glass 30. Taking the elastic modulus as an example, the iron-based metallic glass material comprising the $Fe_aTi_bCo_cNi_dB_eNb_f$ alloy may have an elastic modulus of about 187.6 GPa, and the zirconium-based metallic glass material comprising a $Zr_aCu_bAl_cTa_d$ alloy may have an elastic modulus of about 84.4 GPa.

Figure 3:
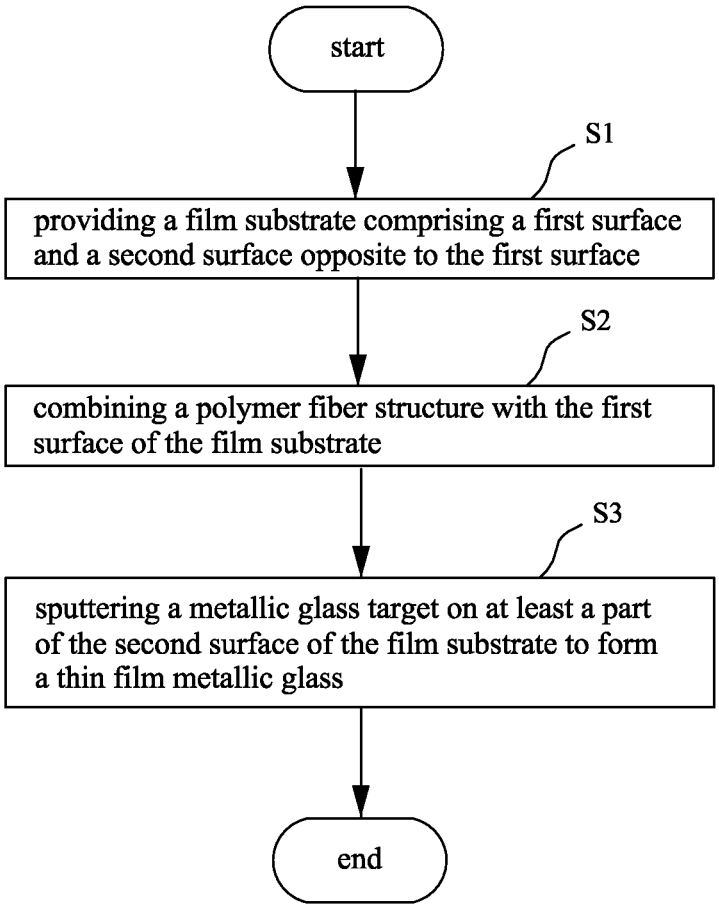
FIG. 3 illustrates a flowchart of a method of manufacturing the diaphragm structure of this disclosure.

Now refer to FIG. 3. FIG. 3 illustrates a flowchart of a method of manufacturing the diaphragm structure of this disclosure. As illustrated in FIG. 3, the method of manufacturing the diaphragm structure of this disclosure comprises steps S1 to S3, which are described in detail below.

Step S1: Providing a film substrate comprising a first surface and a second surface opposite to the first surface.

First, a film substrate 10 suitable as a main structural member of the diaphragm structure 1 of this disclosure is provided. Here, the film substrate 10 may be a prepared film-form material having a fixed size and a fixed shape. The film substrate 10 is exemplified by a polyurethane (PU) material, but this disclosure is not limited thereto. The three-dimensional structure of the film substrate 10 can be formed by die-casting, and the film substrate 10 comprises a first surface 11 and a second surface 12 opposite to each other.

Step S2: Combining a polymer fiber structure with the first surface of the film substrate.

After the film substrate 10 has been provided in Step S1, the polymer fiber structure 20 is combined with the first surface 11 of the film substrate 10. In one embodiment of this disclosure, the polymer fiber structure 20 is superimposed on and combined with the first surface 11 of the film substrate 10 by die-casting, or the polymer fiber structure 20 is fixed to the film substrate 10 by bonding.

Step S3: Sputtering a metallic glass target on at least a part of the second surface of the film substrate to form a thin film metallic glass.

After the polymer fiber structure 20 and the film substrate 10 have been combined with each other in Step S2, a metallic glass target is sputtered on at least a part of the second surface 12 of the film substrate 10 to form the thin film metallic glass 30. In one embodiment of this disclosure, the metallic glass target is sputtered by using a magnetron sputtering system to deposit the metallic glass material on the second surface 12 of the film substrate 10 to form the thin film metallic glass 30, and the metallic glass material may be deposited on a part of the second surface 12 of the film substrate 10 (e.g., the dome 13 of the film substrate 10) or all of the second surface 12 of the film substrate 10 according to different needs. In this embodiment, the magnetron sputtering can be performed by using a DC power source or an RF power source, and the operating conditions for the magnetron sputtering are set at a power regulation of 50-150 W and at a working pressure of 3-5 mTorr, but this disclosure is not limited thereto.

The thin film metallic glass 30 has a thickness of 250 nm to 10 mm.

It is noted that Step S2 is performed before Step S3 according to the foregoing embodiment of the method of manufacturing the diaphragm structure of this disclosure, but the order of execution of Step S2 and Step S3 may be mutually replaced; in other words, for the method for manufacturing the diaphragm structure of this disclosure, the metal glass material may be sputtered on the second surface 12 of the film substrate 10 to form the thin film metallic glass first, and then the polymer fiber structure 20 may be combined with the first surface 11 of the film substrate 10 to obtain the diaphragm structure 1 of this disclosure.

Figure 4:
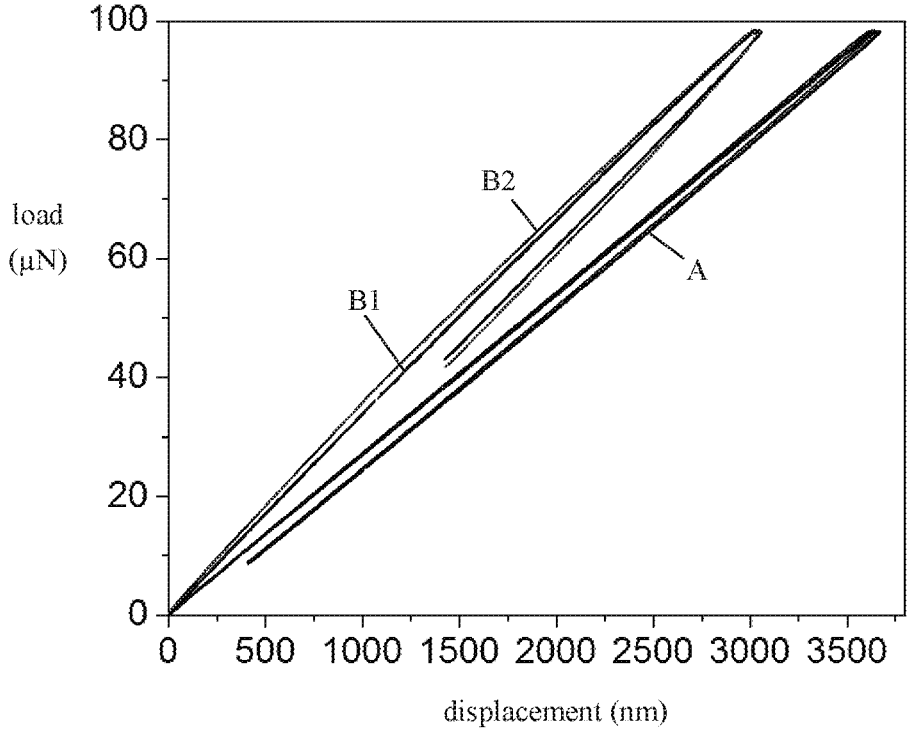
FIG. 4 illustrates the load-displacement curve of the experimental example and the comparative example of the diaphragm structure of this disclosure under force applied to the center of the diaphragm structure.

Refer to FIG. 4, which illustrates the load-displacement curve of the experimental example and the comparative example of the diaphragm structure of this disclosure under force applied to the center of the diaphragm structure. In the following experiments, a composite structure of the film substrate 10 in combination with the polymer fiber structure 20 (i.e., the thin film metallic glass 30 was not formed) is used as a comparative example A. The diaphragm structure having the same composite structure and the thin film metallic glass 30 formed on the surface of the dome 13 on the second surface 12 of the film substrate 10 is used as an experimental example B1. The diaphragm structure having the same composite structure and the thin film metallic glass 30 formed on the surface of the dome 13 and the outer edge 14 on the second surface 12 of the film substrate 10 is used as an experimental example B2. The reaction of the center of the dome 13 of each composite structure under the downward force of the indenter is measured by the nano-indentation test, and the forced conditions of the composite structure under the sound pressure can be simulated. The film substrate 10 comprises polyethylene terephthalate material, and the thin film metallic glass 30 comprises the zirconium-based metallic glass material comprising a $Zr_aCu_bAl_cTa_d$ alloy. The thickness of the formed thin film metallic glass 30 is about 50 nm.

As illustrated in FIG. 4, under the same condition of applying an external force of 98 μN, a tangent slope of the curve during the rebound period measured for each of the comparative example A and the experimental examples B1 and B2 represents the rigidity of the composite structure, and the area defined by the curve represents an absorbable energy of the composite structure under stress. The result data presented in FIG. 4 are summarized as shown in Table 1. As shown in FIG. 4 and Table 1, the tangent slope of the curve during the rebound period exhibited by each of the experimental examples B1 and B2 is greater than the tangent slope of the curve during the rebound period exhibited by the comparative example A; in other words, the rigidity of each of the experimental examples B1 and B2 is greater than the rigidity of the comparative example A. The rigidity of the diaphragm structure of the experimental example B1 is about 34 N/m and is about 21.5% greater than the rigidity of the comparative example A. The rigidity of the diaphragm structure of the experimental example B2 is about 36 N/m and is about 26.8% greater than the rigidity of the comparative example A. In addition, the absorbable energy of the diaphragm structure of the experimental example B1 under stress is about $23*10^{-12}$ joule, which is about 45.6% greater than the absorbable energy of the comparative example A. The absorbable energy of the diaphragm structure of the experimental example B2 under stress is about $44*10^{-12}$ joule, which is about 166.4% greater than the absorbable energy of the comparative example A. Accordingly, the rigidity of the diaphragm structure 1 of this disclosure can be effectively improved by the formation of the thin film metallic glass 30, and the internal loss of the diaphragm structure 1 of this disclosure can be significantly increased, such that the diaphragm structure 1 of this disclosure provides a better audio output effect.

TABLE 1

| | Rigidity (N/m) | Absorbable energy ($10^{-12}$ N · m, Joule) |
|---|---|---|
| Comparative example A | 28.17 | 16.27 |
| Experimental example B1 | 34.23 | 23.69 |
| Experimental example B2 | 35.72 | 43.34 |

Figure 5:
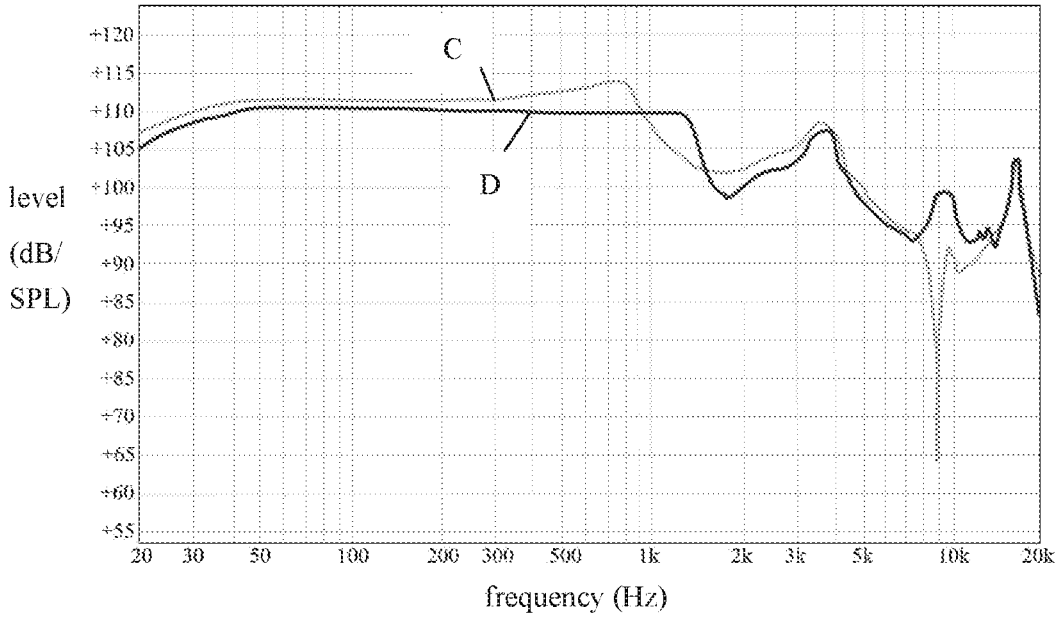
FIG. 5 illustrates the response curves of the experimental example and the comparative example of the diaphragm structure of this disclosure.

Refer to FIG. 5, which illustrates the response curves of the experimental example and the comparative example of the diaphragm structure of this disclosure. The response curve is determined by inputting sound signals of different frequencies to generate sound pressure so as to judge the quality of the diaphragm structure. In the following experiment, a composite structure of the film substrate 10 in combination with the polymer fiber structure 20 (i.e., the thin film metallic glass 30 was not formed) is used as a comparative example C. The diaphragm structure having the same composite structure and the thin film metallic glass 30 formed on the surface of the dome 13 on the second surface 12 of the film substrate 10 is used as an experimental example D. The film substrate 10 comprises polyurethane, and the polymer fiber structure 20 comprises nylon. The thin film metallic glass 30 comprises the zirconium-based metal glass material comprising a $Zr_aCu_bAl_cTa_d$ alloy. The thin film metallic glass 30 has a thickness of 50 nm to 100 mm.

As illustrated in FIG. 5, in this embodiment, when an audio signal having a frequency of between 40 Hz and 1.5 kHz is outputted, a sound pressure level produced by the diaphragm structure 1 of the experimental example D is maintained within a range defined by a stable value±1 dB (e.g., the stable value in FIG. 5 is about 110 dB/SPL), and the curve of the experimental example D at low frequency is smoother than the curve of the comparative example C at low frequency. In other words, the diaphragm structure 1 of this disclosure may provide better sensitivity by the formation of the thin film metallic glass 30. In addition, when an audio signal having a frequency of between 8 kHz and 10 kHz is outputted, an oscillation amplitude of a sound pressure level produced by the diaphragm structure of the experimental example D is maintained at below 5 dB. The curve of the comparative example C at high frequency (about 10 kHz) is drastically lower, but the curve of the experimental example D at the same high frequency is obviously higher. In other words, the quality of the diaphragm structure 1 of this disclosure may be effectively improved by the formation of the thin film metallic glass 30.

In summary, the diaphragm structure 1 of this disclosure comprises a metallic glass material deposited on the surface of the diaphragm structure 1 to form the thin film metallic glass 30. The rigidity and the toughness of the diaphragm structure 1 are effectively improved and good damping characteristics of the diaphragm structure 1 are maintained by utilizing the characteristics of high strength, high elasticity and amorphous structure of the metallic glass material. The overall thickness of the diaphragm structure 1 can be reduced to achieve a lightweight and better sound transmission effect. In addition, the flatness of the surface of the diaphragm structure 1 can be maintained by the amorphous structure of the metallic glass material.

The above detailed description is merely illustrative in nature and is not intended to limit the embodiments of the subject matter or the application and uses of such embodiments. Moreover, while at least one exemplary embodiment has been presented in the foregoing detailed description, it should be appreciated that a vast number of variations exist. It should also be appreciated that the exemplary one or more embodiments described herein are not intended to limit the scope, applicability, or configuration of the claimed subject matter in any way. Rather, the foregoing detailed description will provide those skilled in the art with a convenient guide for implementing the described one or more embodiments. Also, various changes can be made to the function and arrangement of elements without departing from the scope defined by the claims, which include known equivalents and foreseeable equivalents at the time of filing this patent application.

What is claimed is:

1. A diaphragm structure for an audio signal output device, the diaphragm structure comprising:

a film substrate comprising a first surface and a second surface opposite to the first surface;

a polymer fiber structure combined with the first surface of the film substrate; and a thin film metallic glass formed on at least a part of the second surface of the film substrate, wherein an absorbable energy of the diaphragm structure under stress ranges from $23*10^{-12}$ joule to $44*10^{-12}$ joule.

2. The diaphragm structure of claim 1, wherein a metallic glass target is deposited on the second surface of the film substrate by magnetron sputtering to form the thin film metallic glass.

3. The diaphragm structure of claim 1, wherein the film substrate further comprises a dome and an outer edge around the dome, the dome is protruded from the second surface, and the thin film metallic glass is formed on the dome.

4. The diaphragm structure of claim 3, wherein the thin film metallic glass is formed on the dome and the outer edge.

5. The diaphragm structure of claim 1, wherein the thin film metallic glass comprises an iron-based metallic glass material, a zirconium-based metallic glass material or a copper-based metallic glass material.

6. The diaphragm structure of claim 5, wherein the iron-based metallic glass material comprises a $Fe_aTi_bCo_cNi_dB_eNb_f$ alloy, wherein a is 65±10 at %, b is 13±5 at %, c is 8±5 at %, d is 7±5 at %, e is 6±5 at % and f is 1±5 at %, and wherein a, b, c, d, e and f represent integers greater than or equal to 1 and a+b+c+d+e+f=100.

7. The diaphragm structure of claim 5, wherein the zirconium-based metallic glass material comprises a $Zr_aCu_bAl_cTa_d$ alloy, wherein a is 55±10 at %, b is 30±5 at %, c is 10±5 at % and d is 10±5 at %, and wherein a, b, c and d represent integers greater than or equal to 1 and a+b+c+d=100.

8. The diaphragm structure of claim 5, wherein the copper-based metallic glass material comprises a $Cu_aZr_bAl_cTi_d$ alloy, wherein a is 55±10 at %, b is 30±5 at %, c is 10±5 at % and d is 10±5 at %, and wherein a, b, c and d represent integers greater than or equal to 1 and a+b+c+d=100.

9. The diaphragm structure of claim 1, wherein the thin film metallic glass has a thickness of 250 nm to 10 mm.

10. The diaphragm structure of claim 1, having a rigidity of 34 N/m to 36 N/m.

11. The diaphragm structure of claim 1, wherein when an audio signal having a frequency of between 8 kHz and 10 kHz is outputted, an oscillation amplitude of a sound pressure level produced by the diaphragm structure is maintained at below 5 dB.

12. The diaphragm structure of claim 1, wherein when an audio signal having a frequency of between 40 Hz and 1.5 kHz is outputted, a sound pressure level produced by the diaphragm structure is maintained within a range defined by a stable value±1 dB.

13. A method of manufacturing a diaphragm structure, comprising:

providing a film substrate comprising a first surface and a second surface opposite to the first surface;

combining a polymer fiber structure with the first surface of the film substrate; and sputtering a metallic glass target on at least a part of the second surface of the film substrate to form a thin film metallic glass, wherein the thin film metallic glass comprises an iron-based metallic glass material, a zirconium-based metallic glass material or a copper-based metallic glass material, wherein the iron-based metallic glass material comprises a $Fe_aTi_bCo_cNi_dB_eNb_f$ alloy, wherein a is 65±10 at %, b is 13±5 at %, c is 8±5 at %, d is 7±5 at %, e is 6±5 at % and f is 1±5 at %, and wherein a, b, c, d, e and f represent integers greater than or equal to 1 and a+b+c+d+e+f=100.

* * * * *